US012092329B2

(12) United States Patent
Reynolds et al.

(10) Patent No.: US 12,092,329 B2
(45) Date of Patent: Sep. 17, 2024

(54) CMC COMBUSTOR DEFLECTOR

(71) Applicant: General Electric Company, Schenectady, NY (US)

(72) Inventors: Brandon ALlanson Reynolds, Cincinnati, OH (US); Matthew Mark Weaver, Loveland, OH (US); Daniel Patrick Kerns, Mason, OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 17/680,751

(22) Filed: Feb. 25, 2022

(65) Prior Publication Data

US 2022/0228744 A1 Jul. 21, 2022

Related U.S. Application Data

(60) Continuation of application No. 16/902,308, filed on Jun. 16, 2020, now Pat. No. 11,262,072, which is a division of application No. 15/421,536, filed on Feb. 1, 2017, now Pat. No. 10,690,347.

(51) Int. Cl.

| | |
|---|---|
| ***F23R 3/00*** | (2006.01) |
| ***F23R 3/14*** | (2006.01) |
| ***F23R 3/28*** | (2006.01) |
| ***F23R 3/60*** | (2006.01) |

(52) U.S. Cl.

CPC ..... *F23R 3/007* (2013.01); *F23R 3/14* (2013.01); *F23R 3/283* (2013.01); *F23R 3/286* (2013.01); *F23R 3/60* (2013.01); *F23R 2900/00017* (2013.01)

(58) Field of Classification Search

None

See application file for complete search history.

(56) References Cited

U.S. PATENT DOCUMENTS

| | | | | |
|---|---|---|---|---|
| 4,622,821 | A | 11/1986 | Madden | |
| 6,212,870 | B1 * | 4/2001 | Thompson | F23R 3/60 60/746 |
| 6,530,227 | B1 * | 3/2003 | Young | F23R 3/286 60/776 |
| 6,581,386 | B2 | 6/2003 | Young et al. | |
| 6,983,599 | B2 | 1/2006 | Young et al. | |

(Continued)

*Primary Examiner* — Ehud Gartenberg
*Assistant Examiner* — Jacek Lisowski
(74) *Attorney, Agent, or Firm* — Dority & Manning, P.A.

(57) ABSTRACT

Combustor dome assemblies having combustor deflectors are provided. For example, a combustor dome assembly comprises a combustor dome defining an opening; a ceramic matrix composite (CMC) deflector positioned adjacent the combustor dome on an aft side of the assembly; a fuel-air mixer defining a groove about an outer perimeter thereof; and a seal plate including a key. The CMC deflector includes a cup extending forward through the opening in the combustor dome that defines one or more bayonets and a slot. The bayonets are received in the fuel-air mixer groove, and the seal plate key is received in the CMC deflector slot. In another embodiment, where the seal plate may be omitted, a spring is positioned between the fuel-air mixer and the CMC deflector to hold the CMC deflector in place with respect to the combustor dome. Methods of assembling combustor dome assemblies having CMC deflectors also are provided.

17 Claims, 13 Drawing Sheets

(56) References Cited

U.S. PATENT DOCUMENTS

| | | | | |
|---|---|---|---|---|
| 7,140,560 | B2 | 11/2006 | Stotts et al. | |
| 7,464,554 | B2 | 12/2008 | Cheung et al. | |
| 7,775,051 | B2 | 8/2010 | Hernandez et al. | |
| 8,141,371 | B1 | 3/2012 | Habarou et al. | |
| 8,756,935 | B2 | 6/2014 | Duval et al. | |
| 8,763,406 | B2 | 7/2014 | Pieussergues et al. | |
| 8,943,835 | B2 | 2/2015 | Corsmeier et al. | |
| 9,021,812 | B2 | 5/2015 | Pardington et al. | |
| 9,310,083 | B2 * | 4/2016 | Bunel | F23R 3/283 |
| 10,317,085 | B2 | 6/2019 | Hannwacker et al. | |
| 2004/0083735 | A1 | 5/2004 | Borns et al. | |
| 2010/0326078 | A1 | 12/2010 | Pieussergues et al. | |
| 2013/0025287 | A1 | 1/2013 | Cunha | |
| 2016/0252250 | A1 | 9/2016 | Bunker et al. | |
| 2017/0248320 | A1 | 8/2017 | Hannwacker et al. | |

* cited by examiner

CMC COMBUSTOR DEFLECTOR

CROSS-REFERENCE TO RELATED APPLICATIONS

This application is a continuation of and claims priority to U.S. application Ser. No. 16/902,308, filed Jun. 16, 2020, which is a divisional of and claims priority to U.S. application Ser. No. 15/421,536, filed Feb. 1, 2017, now issued as U.S. Pat. No. 10,690,347, the contents of both of which are incorporated herein by reference.

FIELD

The present subject matter relates generally to combustion assemblies of gas turbine engines. More particularly, the present subject matter relates to combustor deflectors of combustion assemblies.

BACKGROUND

A gas turbine engine generally includes a fan and a core arranged in flow communication with one another. Additionally, the core of the gas turbine engine generally includes, in serial flow order, a compressor section, a combustion section, a turbine section, and an exhaust section. In operation, air is provided from the fan to an inlet of the compressor section where one or more axial compressors progressively compress the air until it reaches the combustion section, which includes a combustor defining a combustion chamber. Fuel is mixed with the compressed air and burned within the combustion chamber to provide combustion gases. The combustion gases are routed from the combustion section to the turbine section. The flow of combustion gases through the turbine section drives the turbine section and is then routed through the exhaust section, e.g., to atmosphere.

Typically, the combustor includes a combustor dome at its forward end, and one or more combustor deflectors are positioned within the combustion chamber just aft of the combustor dome, e.g., to protect the combustor dome from the combustion gases. However, the combustor deflectors usually are made of metal, which may limit engine operating temperatures and may sustain damage such as metal oxidation and chipping of a thermal barrier coating (TBC) applied to the deflector. In some instances, cracked metal deflectors may liberate and damage airfoils and/or other engine components. Thus, metal combustor deflectors may frequently cause unscheduled engine removal and maintenance.

More commonly, non-traditional high temperature materials, such as ceramic matrix composite (CMC) materials, are being used in gas turbine applications. Components fabricated from such materials have a higher temperature capability compared with typical components, e.g., metal components, which may allow improved component performance and/or increased engine temperatures. Accordingly, using high temperature materials for combustor deflectors may improve the durability of the deflectors, as well as allow reduction of impingement cooling or other types of cooling of the deflectors, which may improve engine performance. Therefore, combustor deflectors that overcome one or more disadvantages of existing designs would be desirable. In particular, a CMC combustor deflector would be beneficial. Additionally, a combustor assembly having one or more CMC combustor deflectors would be useful. Further, methods of assembling combustor assemblies having CMC combustor deflectors would be advantageous.

BRIEF DESCRIPTION

Aspects and advantages of the invention will be set forth in part in the following description, or may be obvious from the description, or may be learned through practice of the invention.

In one exemplary embodiment of the present disclosure, a combustor dome assembly having a forward side and an aft side is provided. The combustor dome assembly comprises a combustor dome defining an opening; a ceramic matrix composite (CMC) deflector positioned adjacent the combustor dome on the aft side of the combustor dome assembly; a fuel-air mixer defining a groove about an outer perimeter of the fuel-air mixer; and a seal plate including a key. The CMC deflector includes a cup extending forward through the opening in the combustor dome, and the cup defines one or more bayonets and a slot. The bayonets are received in the groove of the fuel-air mixer, and the seal plate key is received in the slot of the CMC deflector.

In another exemplary embodiment of the present disclosure, a combustor dome assembly having a forward side and an aft side is provided. The combustor dome assembly comprises a combustor dome defining an opening; a ceramic matrix composite (CMC) deflector positioned adjacent the combustor dome on the aft side of the combustor dome assembly; and a fuel-air mixer positioned adjacent the combustor dome of the forward side of the combustor dome assembly. A spring is positioned between the fuel-air mixer and the CMC deflector to hold the CMC deflector in place with respect to the combustor dome.

In a further exemplary embodiment of the present disclosure, a method of assembling a combustor dome assembly is provided. The combustor dome assembly has a forward side and an aft side. The method comprises assembling a combustor dome with a combustor; inserting a seal plate from the forward side of the assembly; attaching the seal plate to the combustor dome; inserting a CMC deflector from an aft side of the assembly, the CMC deflector having one or more bayonets; inserting a fuel-air mixer from a forward side of the assembly, the fuel-air mixer defining a groove for receipt of the one or more bayonets; rotating the fuel-air mixer to engage the bayonets; and attaching the fuel-air mixer to the seal plate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
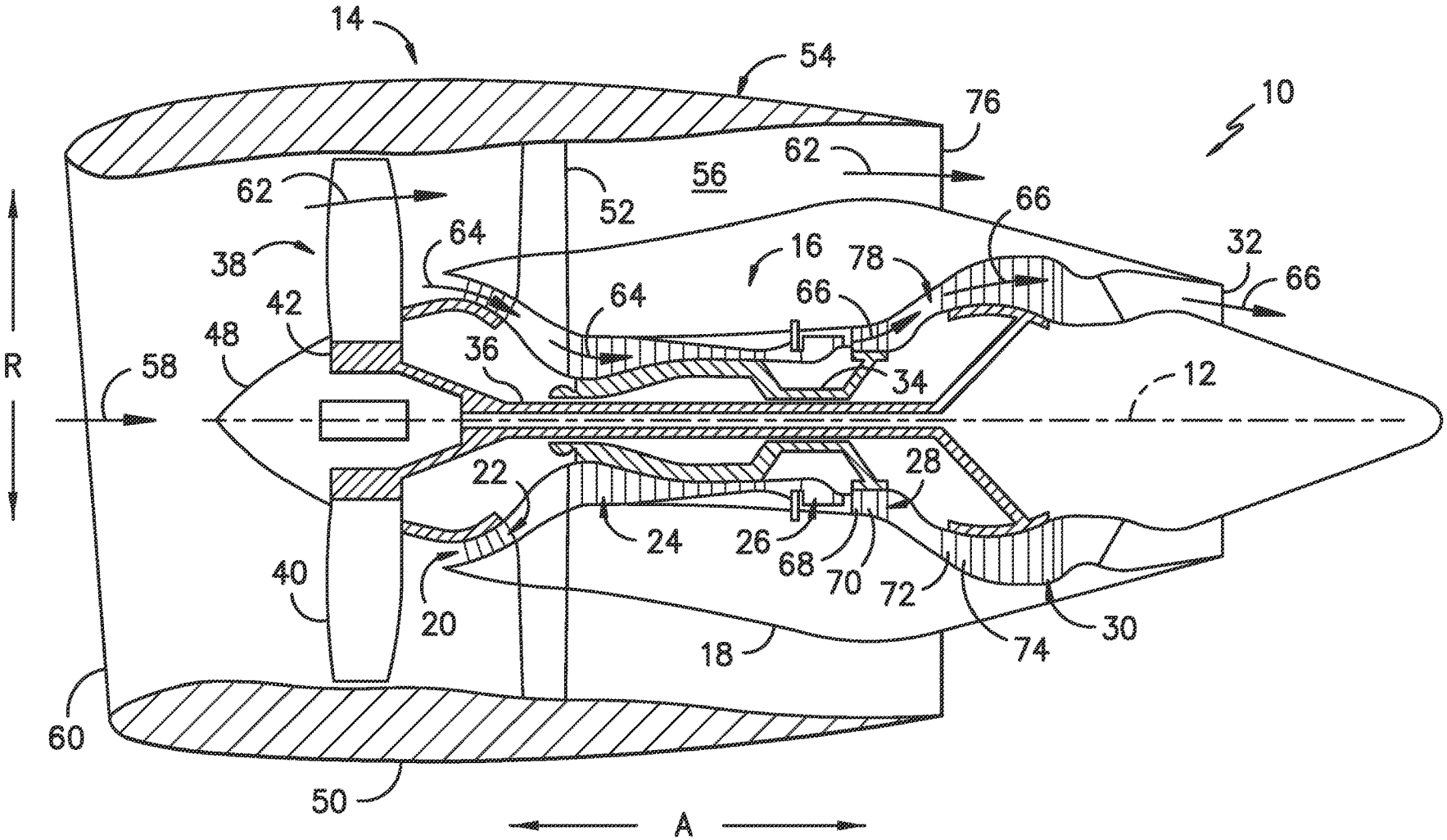
FIG. 1 provides a schematic cross-section view of an exemplary gas turbine engine according to various embodiments of the present subject matter.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows and "downstream" refers to the direction to which the fluid flows.

Referring now to the drawings, wherein identical numerals indicate the same elements throughout the figures, FIG. 1 is a schematic cross-sectional view of a gas turbine engine in accordance with an exemplary embodiment of the present disclosure. More particularly, for the embodiment of FIG. 1, the gas turbine engine is a high-bypass turbofan jet engine 10, referred to herein as "turbofan engine 10." As shown in FIG. 1, the turbofan engine 10 defines an axial direction A (extending parallel to a longitudinal centerline 12 provided for reference) and a radial direction R. In general, the turbofan 10 includes a fan section 14 and a core turbine engine 16 disposed downstream from the fan section 14.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22.

For the depicted embodiment, fan section 14 includes a fan 38 having a plurality of fan blades 40 coupled to a disk 42 in a spaced apart manner. As depicted, fan blades 40 extend outward from disk 42 generally along the radial direction R. The fan blades 40 and disk 42 are together rotatable about the longitudinal axis 12 by LP shaft 36. In some embodiments, a power gear box having a plurality of gears may be included for stepping down the rotational speed of the LP shaft 36 to a more efficient rotational fan speed.

Referring still to the exemplary embodiment of FIG. 1, disk 42 is covered by rotatable front nacelle 48 aerodynamically contoured to promote an airflow through the plurality of fan blades 40. Additionally, the exemplary fan section 14 includes an annular fan casing or outer nacelle 50 that circumferentially surrounds the fan 38 and/or at least a portion of the core turbine engine 16. It should be appreciated that nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass airflow passage 56 therebetween.

During operation of the turbofan engine 10, a volume of air 58 enters turbofan 10 through an associated inlet 60 of the nacelle 50 and/or fan section 14. As the volume of air 58 passes across fan blades 40, a first portion of the air 58 as indicated by arrows 62 is directed or routed into the bypass airflow passage 56 and a second portion of the air 58 as indicated by arrows 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core turbine engine 16.

In some embodiments, components of turbofan engine 10, particularly components within hot gas path 78, may comprise a ceramic matrix composite (CMC) material, which is a non-metallic material having high temperature capability. Exemplary CMC materials utilized for such components may include silicon carbide (SiC), silicon, silica, or alumina matrix materials and combinations thereof. Ceramic fibers may be embedded within the matrix, such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAIMIC®), alumina silicates (e.g., Nextel's 440 and 480), and chopped whiskers and fibers (e.g., Nextel's 440 and SAFFIL®), and optionally ceramic particles (e.g., oxides of Si, Al, Zr, Y, and combinations thereof) and inorganic fillers (e.g., pyrophyllite, wollastonite, mica, talc, kyanite, and montmorillonite). For example, in certain embodiments, bundles of the fibers, which may include a ceramic refractory material coating, are formed as a reinforced tape, such as a unidirectional reinforced tape. A plurality of the tapes may be laid up together (e.g., as plies) to form a preform component. The bundles of fibers may be impregnated with a slurry composition prior to forming the preform or after formation of the preform. The preform may then undergo thermal processing, such as a cure or burn-out to yield a high char residue in the preform, and subsequent chemical processing, such as melt-infiltration with silicon, to arrive at a component formed of a CMC material having a desired chemical composition. In other embodiments, the CMC material may be formed as, e.g., a carbon fiber cloth rather than as a tape.

As stated, components comprising a CMC material may be used within the hot gas path 78, such as within the combustion and/or turbine sections of engine 10. However, CMC components may be used in other sections as well, such as the compressor and/or fan sections. As a particular example described in greater detail below, a deflector for a combustor dome may be formed from a CMC material, e.g., to provide greater temperature capability of the deflector to better protect the dome from the temperature of combustion gases and/or to reduce cooling of the deflector.

Figure 2:
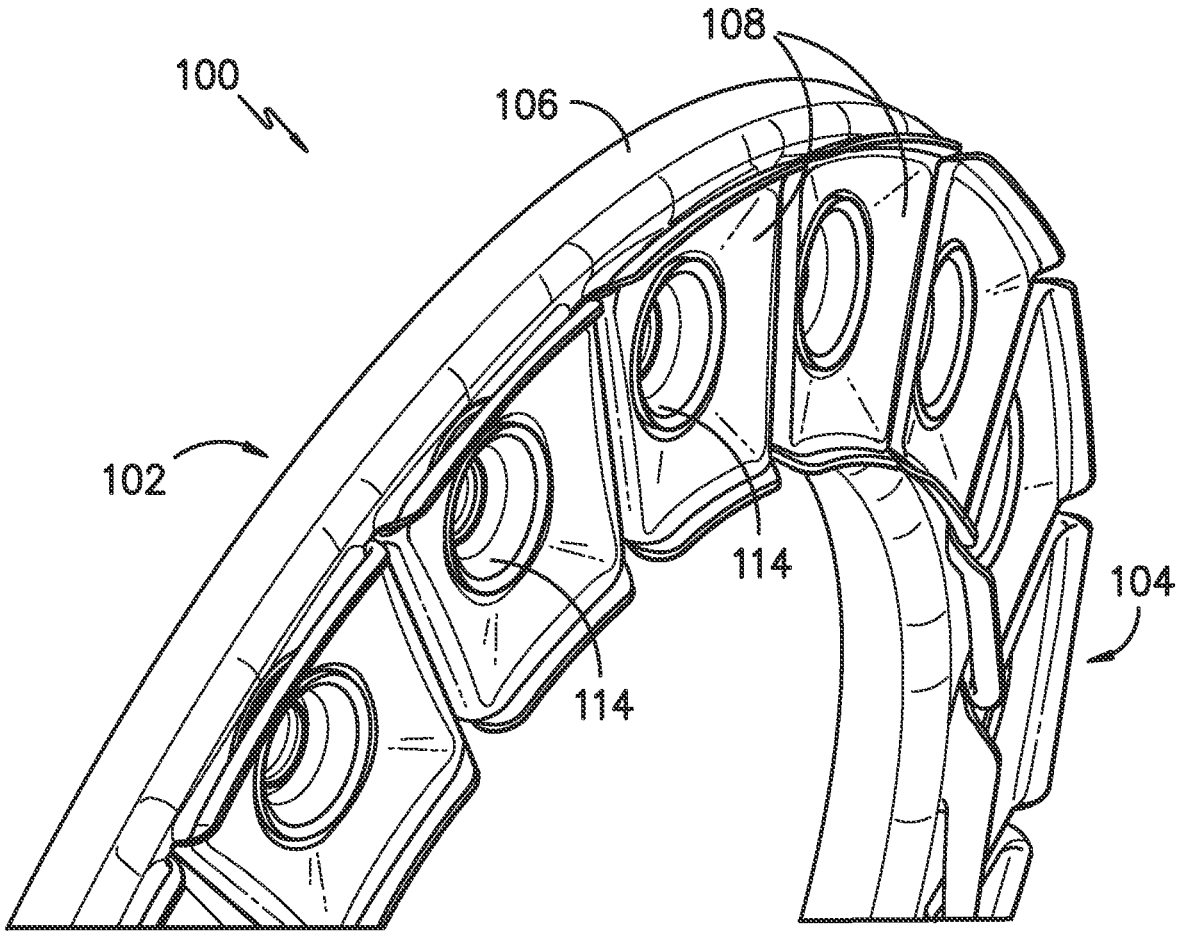
FIG. 2 provides a perspective view of a portion of a combustor dome assembly according to an exemplary embodiment of the present subject matter.

Turning to FIG. 2, a perspective view is provided of a portion of a combustor dome assembly 100 according to an exemplary embodiment of the present subject matter. As shown in FIG. 2, the exemplary combustor dome assembly 100 has a forward side 102 and an aft side 104. Further, the combustor dome assembly 100 includes a generally annular combustor dome 106 and a plurality of combustor deflectors 108 positioned adjacent the aft side 104. As will be generally understood, the combustion section 26 includes a combustor (not shown) that defines a combustion chamber (not shown) in which the fuel is burned to provide combustion gases 66. Each deflector 108 includes a body 109 configured to help shield the combustor dome 106, e.g., from the heat of the combustion gases 66.

Figure 3:
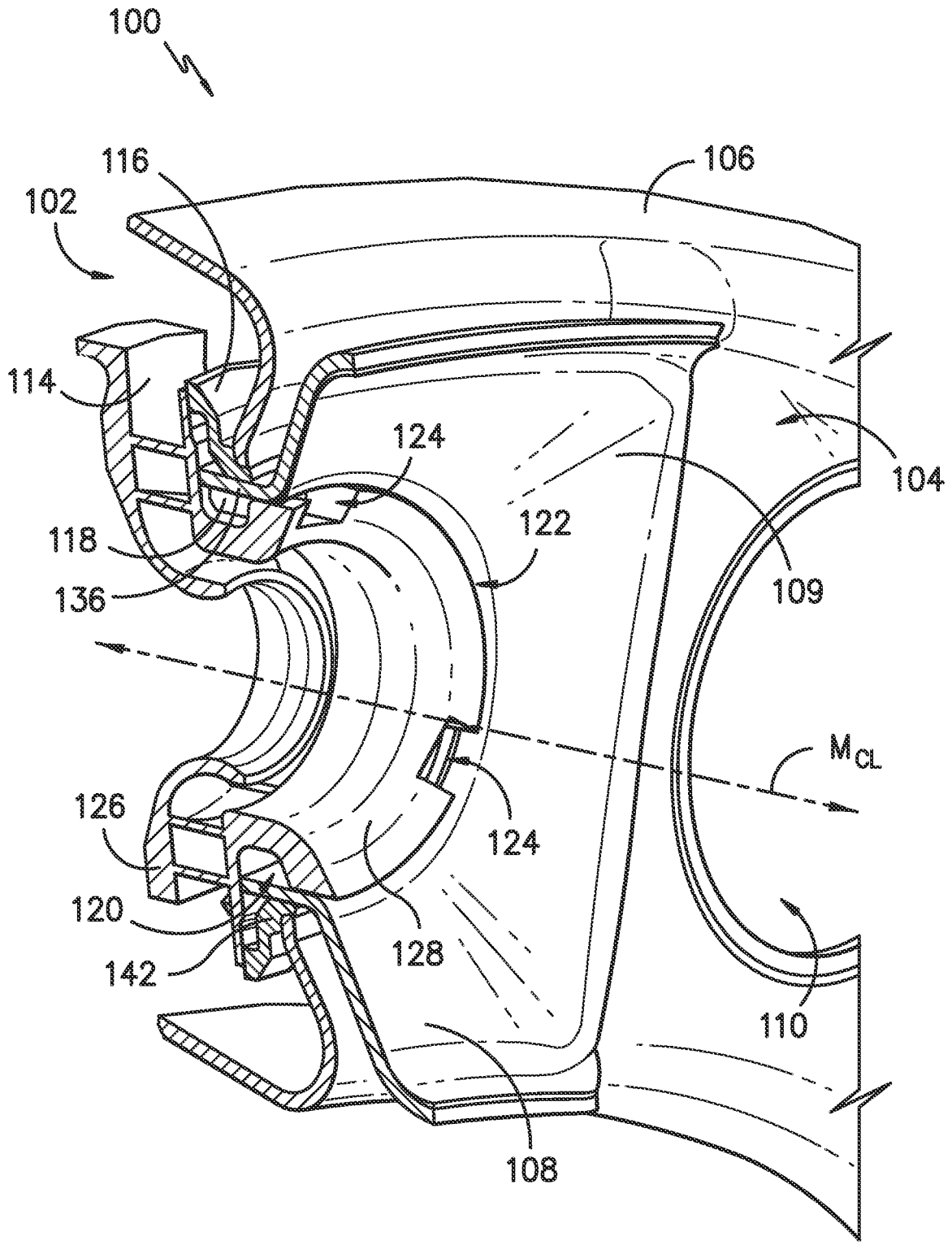
FIG. 3 provides a perspective cross-section view of the combustor dome assembly of FIG. 2 according to an exemplary embodiment of the present subject matter.

The combustor dome 106 generally is positioned at a forward end of the combustor and defines a plurality of openings 110 (FIG. 3). Each deflector 108 defines an opening 112 (FIG. 4) that aligns with a dome opening 110. A fuel-air mixer 114 is positioned through each dome opening 110 and deflector opening 112; the fuel-air mixers 114 provide a mixture of fuel and air to the combustion chamber located immediately downstream of the combustor dome assembly 100. As described in greater detail herein, each mixer 114 helps retain its respective deflector 108 within the dome opening 110.

FIG. 3 provides a perspective cross-section view of the combustor dome assembly 100 of FIG. 2 according to an exemplary embodiment of the present subject matter. As depicted in FIG. 3, the combustor dome assembly 100 further comprises a seal plate 116 that helps retain the deflector 108 within the dome opening 110, as described in greater detail below. FIG. 3 also illustrates that the deflector 108 defines at least one projection or bayonet 118, which fits within a groove 120 defined in an outer perimeter of an aft end 122 of the mixer 114. The bayonet(s) 118 and groove 120 thus form a bayonet joint, which couples the deflector 108 and the mixer 114. Further, in the depicted embodiment, the mixer 114 defines a slot 124 corresponding to each bayonet 118, i.e., each slot 124 is configured for the passage of a bayonet 118 therethrough during assembly of the mixer 114 with the deflector 108. After the bayonets 118 pass through the slots 124, the mixer 114 may be twisted or rotated such that the bayonets 118 are no longer aligned with the slots 124, thereby retaining the bayonets 118 in the groove 120 of the mixer 114. In an exemplary embodiment, the deflector 108 includes three bayonets and the mixer 114 defines three slots 124 (one slot 124 for each bayonet 118), but the deflector 108 and mixer 114 may include any suitable number and configuration of bayonets 118 and slots 124, respectively. Further, in some embodiments, a key may be attached, e.g., welded, within each mixer slot 124, e.g., to fill the slot and avoid leakage and/or aerodynamic effects that could result from the slots 124. In other embodiments, as appropriate, the mixer 114 may define the bayonets and the deflector 108 may define the groove.

Figure 6:
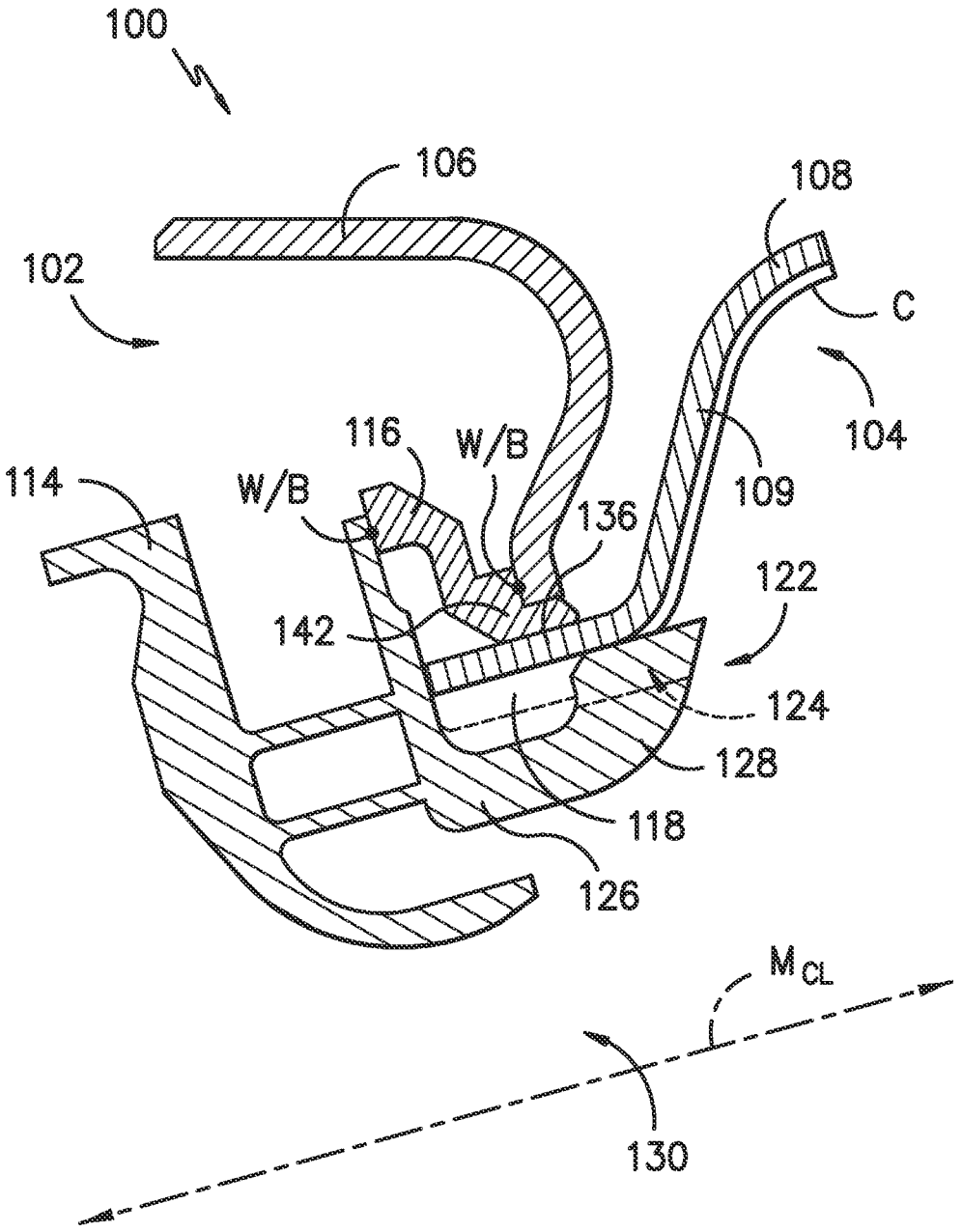
FIG. 6 provides a cross-section view of a portion of the combustor dome assembly of FIG. 3.

FIG. 3 further illustrates that the aft end 122 of the mixer 114 is positioned within the dome opening 110 and the deflector opening 112. Moreover, the aft end 122 generally flares outward from a generally cylindrical midsection 126 to form a flare cone 128. Additionally, an opening 130 defined through mixer 114, e.g., for the passage of a fuel-air mixture from the mixer 114 to the combustion chamber, that is aligned with the dome opening 110 and the deflector opening 112. The mixer 114 further defines an axial mixer centerline $M_{CL}$, which generally extends axially through the mixer opening 126, but need not be parallel to the engine centerline 12, e.g., as shown in FIG. 6, the mixer centerline is at an angle of approximately 30 degrees to the engine centerline.

Figure 4:
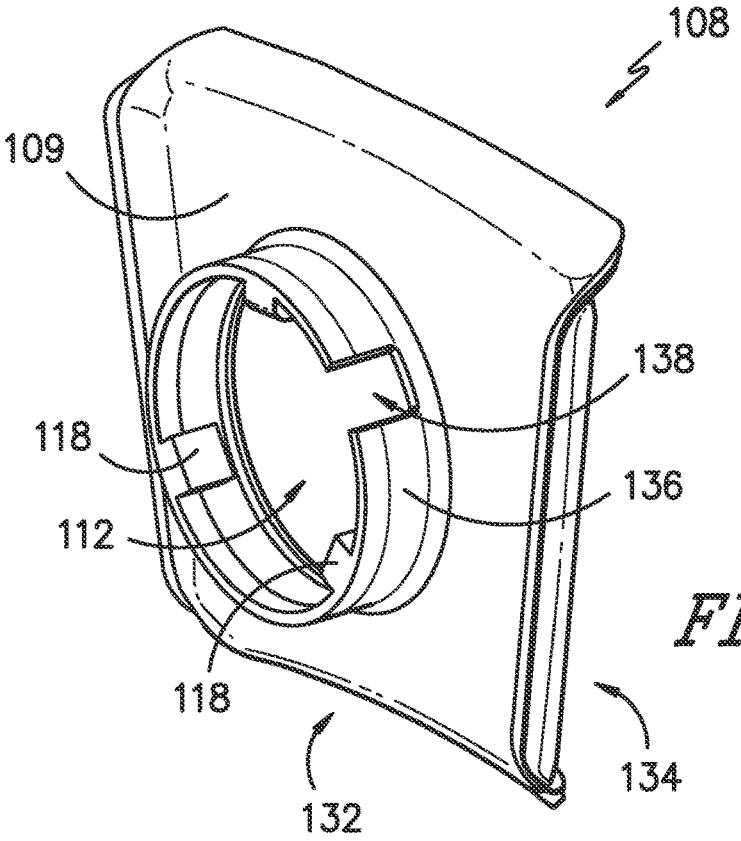
FIG. 4 provides a forward side, perspective view of a CMC combustor deflector according to an exemplary embodiment of the present subject matter.

Referring now to FIG. 4, a forward side, perspective view is provided of a combustor deflector 108 according to an exemplary embodiment of the present subject matter. The deflector 108 has a forward side 132 and an aft side 134. A cup 136 projects forwardly from the forward side 132 and defines the deflector opening 112. As such, the cup 136 extends forward through the dome opening 110 when the deflector 108 is positioned adjacent the combustor dome 106 as shown in FIG. 3. The deflector cup 136 may be generally cylindrical as illustrated in FIG. 4, but the cup 136 may have different shapes or configurations in other embodiments.

Figure 5:
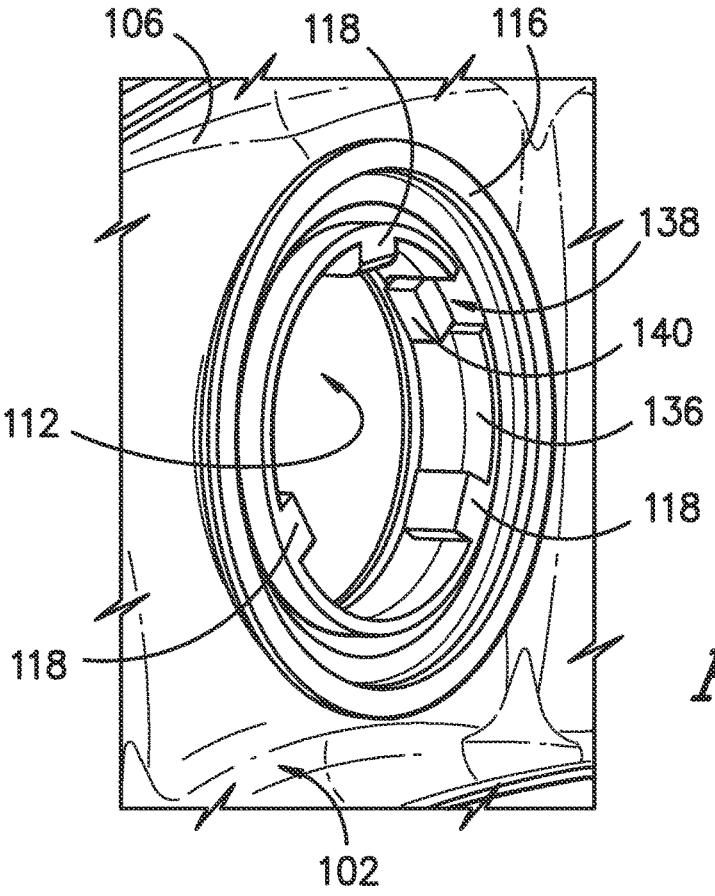
FIG. 5 provides a forward side, perspective view of a portion of the combustor dome assembly of FIG. 3.

Further, the cup 136 defines a slot 138. As shown in FIG. 5, which provides a forward side, perspective view of a portion of the combustor dome assembly 100 of FIG. 3, the seal plate 116 includes a key 140 that is received within the slot 138 defined by the deflector cup 136. The key 140 and slot 138 thereby form a tongue and groove joint that helps prevent rotational movement of the deflector 108. In some embodiments, the deflector 108 may include the key 140 and the seal plate 116 may define the slot 138.

As further illustrated in FIGS. 3 and 5, the seal plate 116 is positioned adjacent the forward side 102 of the combustor dome assembly 100. The seal plate 116 includes a generally annular wall 142 that extends aft through the opening 110 in the combustor dome 106 and defines an opening through the seal plate 116. The wall 142 is positioned between the combustor dome 106 and the cup 136 of the deflector 108. As such, the deflector cup 136 is positioned within the seal plate opening.

Turning to FIG. 6, a cross-section view is provided of a portion of the combustor dome assembly 100 of FIG. 3. In the depicted embodiment, each of the combustor dome 106, mixer 114, and seal plate 116 are formed from a metallic material, such as a metal or metal alloy. To help retain the mixer 114 and seal plate 116 in the assembly 100, the seal plate 116 is attached to the combustor dome 106, e.g., by welding or brazing, as generally indicated at area W/B in FIG. 6, and the mixer 114 is attached to the seal plate 116, e.g., by welding or brazing, as generally shown at area W/B in FIG. 6. As previously described, the deflector 108 preferably is formed from a CMC material such that the deflector is a CMC deflector 108. The CMC deflector 108 is retained in the assembly 100 by the bayonet joint between the CMC deflector 108 and the mixer 114 and the tongue and groove joint between the CMC deflector 108 and the seal plate 116. Further, during operation of the engine 10, a pressure differential from the forward side 102 to the aft side 104 presses the CMC deflector 108 aft and against the mixer 114, which helps axially retain the deflector 108. Additionally, a coating C, such as an environmental barrier coating (EBC) or thermal barrier coating (TBC), may be applied to the deflector 108, e.g., to help protect the deflector during operation of engine 10.

Moreover, it will be appreciated that the metallic components, e.g., the combustor dome 106, mixer 114, and seal plate 116, have a different rate of thermal expansion than the CMC deflector 108. More particularly, the metallic components will grow faster than the CMC deflector 108 and will begin to thermally expand at lower temperatures than the CMC deflector 108. As such, under cold, non-operating engine conditions the seal plate opening defined by the wall 142 is sized to receive the deflector cup 136, and the deflector opening 112 is sized to receive the mixer 114. A gap may be defined between an inner diameter of the deflector cup 136 and an outer diameter of the mixer 114 such that the mixer 114 has room to grow as the engine temperatures increase. For example, at hot, operating engine conditions, the inner diameter of the deflector cup 136 may be supported by the outer diameter of the mixer 114. Thus, the sizing of the various components may help radially retain the CMC deflector 108 under cold and hot engine conditions.

Figure 7:
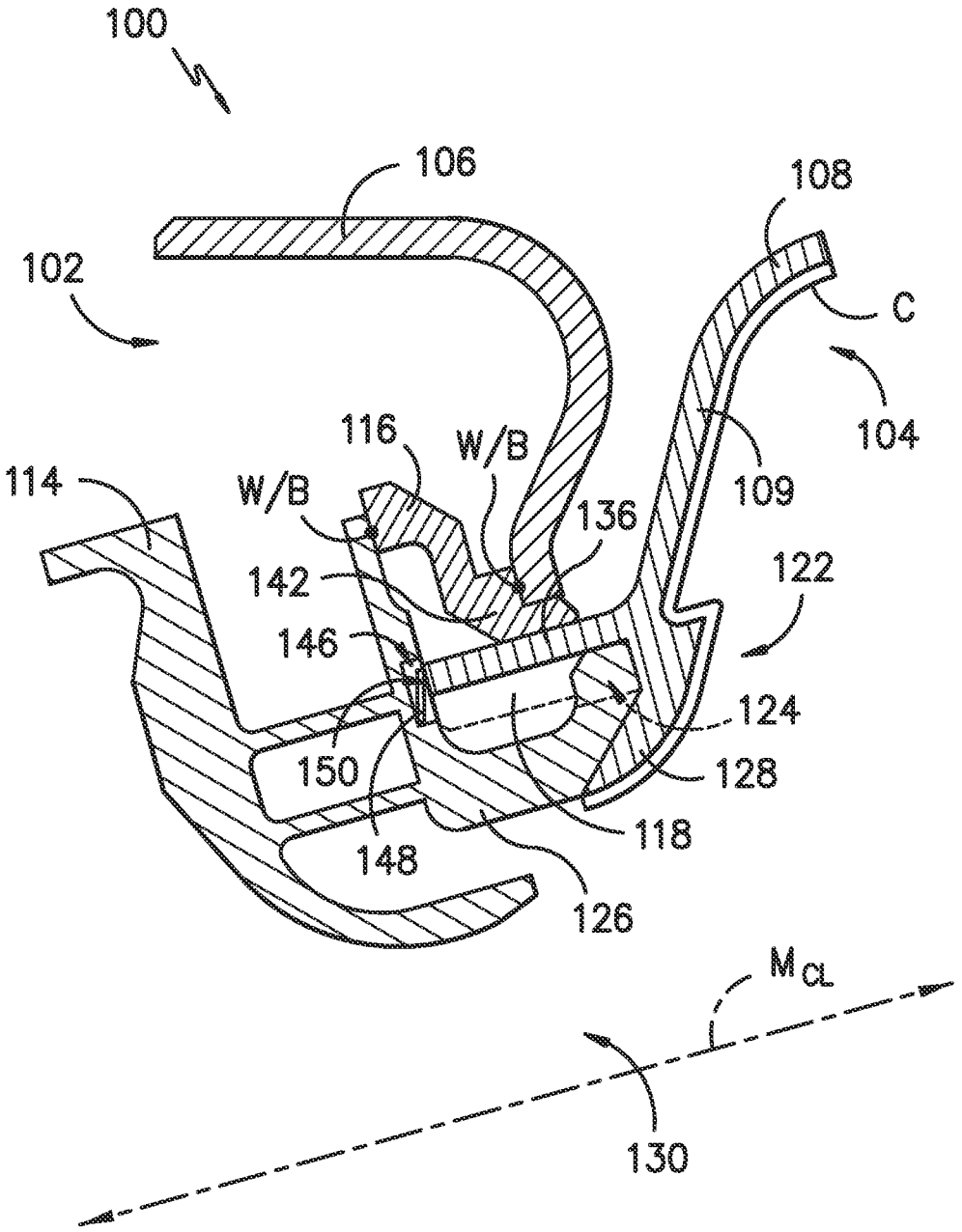
FIG. 7 provides a cross-section view of the portion of the combustor dome assembly of FIGS. 3 and 6 according to another exemplary embodiment of the present subject matter.

FIG. 7 provides a cross-section view of the portion of the combustor dome assembly 100 of FIGS. 3 and 6 according to another exemplary embodiment of the present subject matter. Similar to the embodiment shown in FIGS. 3 and 6, the deflector 108 illustrated in FIG. 7 includes at least one bayonet 118, which is received within the groove 120 defined in the outer perimeter of the aft end 122 of mixer 114. However, unlike the previous embodiment of assembly 100, the deflector 108 also includes at least a portion of the flare cone 128 that is shown as part of the mixer 114 in the embodiment of FIGS. 3 and 6. Thus, where the deflector 108 is a CMC deflector, the flare cone 128 included with the deflector 108 also is made from a CMC material. As such, the CMC flare cone 128 may help protect the metallic mixer 114 from the temperatures within the combustion chamber. Additionally, the flare cone 128 of the CMC deflector 108 covers the mixer slots 124 on the aft side 104 of the combustor dome assembly 100, such that the flare cone 128 shields the mixer 114 from the combustion temperatures as well as helps prevent combustion gas leakage through the mixer slots 124.

As further illustrated in FIG. 7, the mixer 114 defines a pocket 146, and a washer or spring 148, such as a Belleville washer or the like, is received within the pocket 146. The spring 148 is positioned between the mixer 114 and the CMC deflector 108 to hold the deflector in place with respect to the combustor dome 106. More particularly, the spring 148 presses against a forward edge 150 of the deflector cup 136 to axially load the deflector 108 into the mixer 114 and thereby to help hold the deflector 108 in place axially. Further, as described above with respect to FIG. 6, the seal plate 116 may be attached to the combustor dome 106 and the mixer 114 attached to the seal plate 116, where the seal plate 116 and mixer 114 are attached by welding, brazing, or the like.

Figure 8:
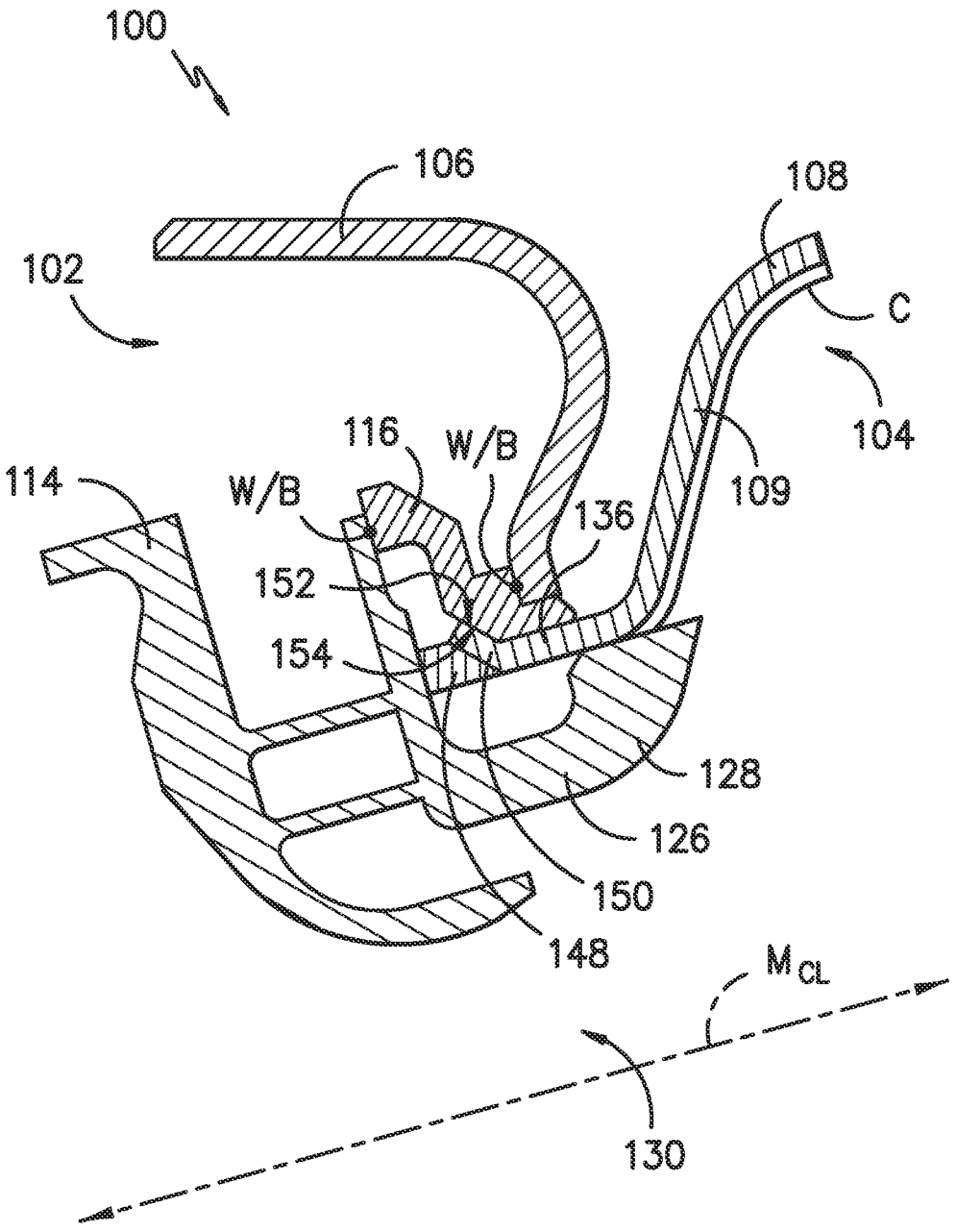
FIGS. 8 through 13 provide cross-section views of a portion of the combustion dome assembly of FIG. 2 according to other exemplary embodiments of the present subject matter.

FIGS. 8 through 13 provide cross-section views of a portion of the combustion dome assembly 100 according to other exemplary embodiments of the present subject matter. Referring to FIG. 8, in one embodiment of the combustor dome assembly 100, the forward edge 150 of deflector cup 136 is flared outward such that the edge 150 is chamfered. A washer or spring 148, such as a Belleville washer or the like, is positioned between the mixer 114 and the deflector 108 to hold the deflector in place with respect to the combustor dome 106. More particularly, the spring 148 is positioned between the chamfered edge 150 and the mixer 114 to axially load the deflector 108 into the seal plate 116 and thereby to help hold the deflector 108 in place axially. The spring 148 helps to press an outside surface 152 of the edge 150 into a surface 154 of the seal plate 116, such that the deflector outside surface 152 interfaces with the seal plate surface 154. It will be appreciated that, although the flare cone 128 is illustrated in FIG. 8 as part of the mixer 114, in suitable embodiments, the flare cone 128 may be included as part of the deflector 108 as described with respect to FIG. 7. Further, in some embodiments, the seal plate 116 may have to be split circumferentially to allow for assembly.

Figure 9:
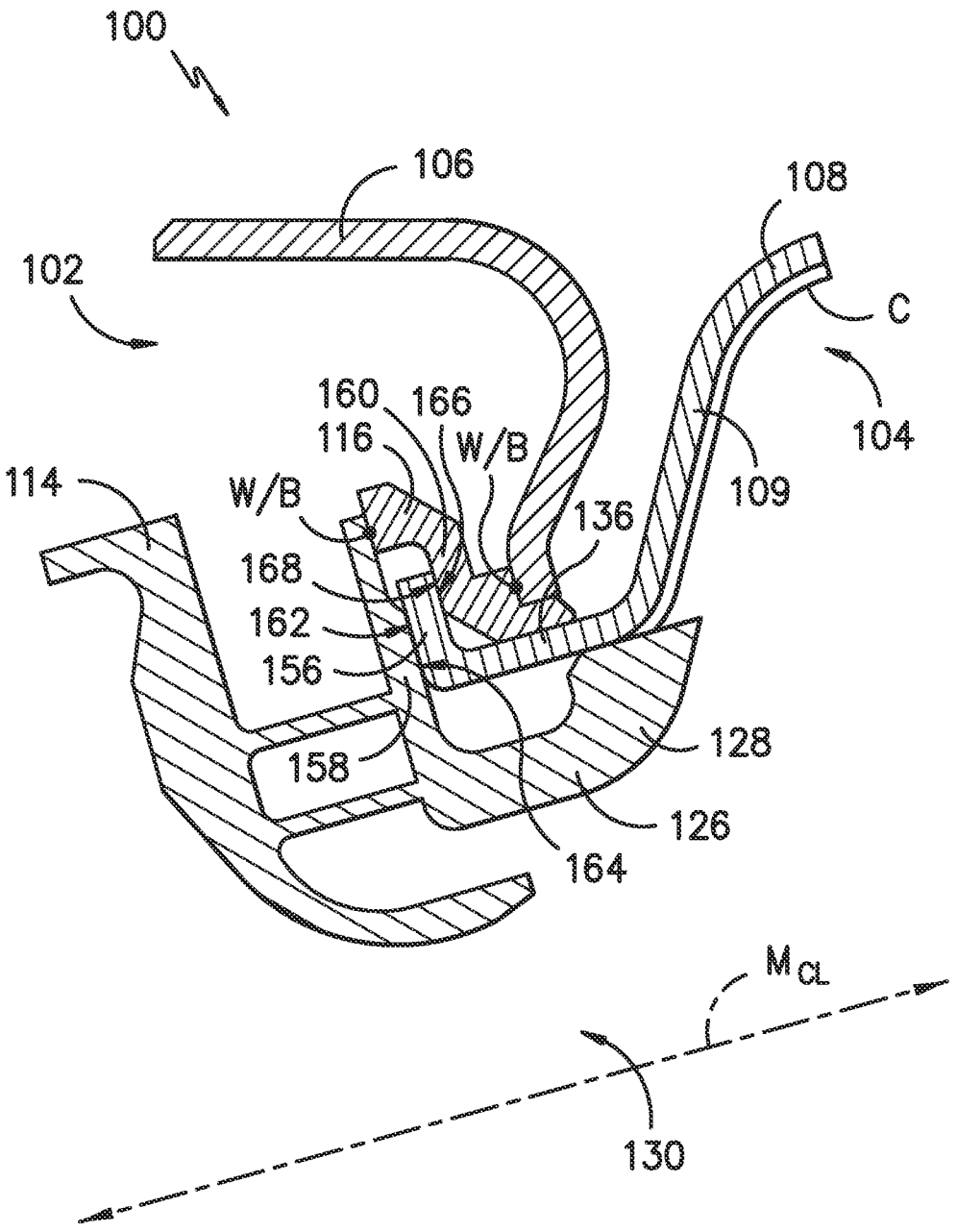

In the embodiment of combustor dome assembly 100 shown in FIG. 9, a flange 156 is defined about the forward edge 150 of deflector cup 136. The flange 156 is received between a shoulder 158 of the mixer 114 and a shoulder 160 of the seal plate 116. More specifically, the flange 156 is captured between the mixer shoulder 158 and the seal plate shoulder 160 to hold the deflector 108 in place. As such, a first surface 162 of the flange 156 interfaces with a surface 164 of the mixer shoulder 158, and a second surface 166 of the flange 156 interfaces with a surface 168 of the seal plate shoulder 160. Further, as stated with respect to FIG. 8, although the flare cone 128 is illustrated in FIG. 9 as part of the mixer 114, in suitable embodiments, the flare cone 128 may be included as part of the deflector 108 as described with respect to FIG. 7. Moreover, in some embodiments, the seal plate 116 may have to be split circumferentially to allow for assembly.

Figure 10:
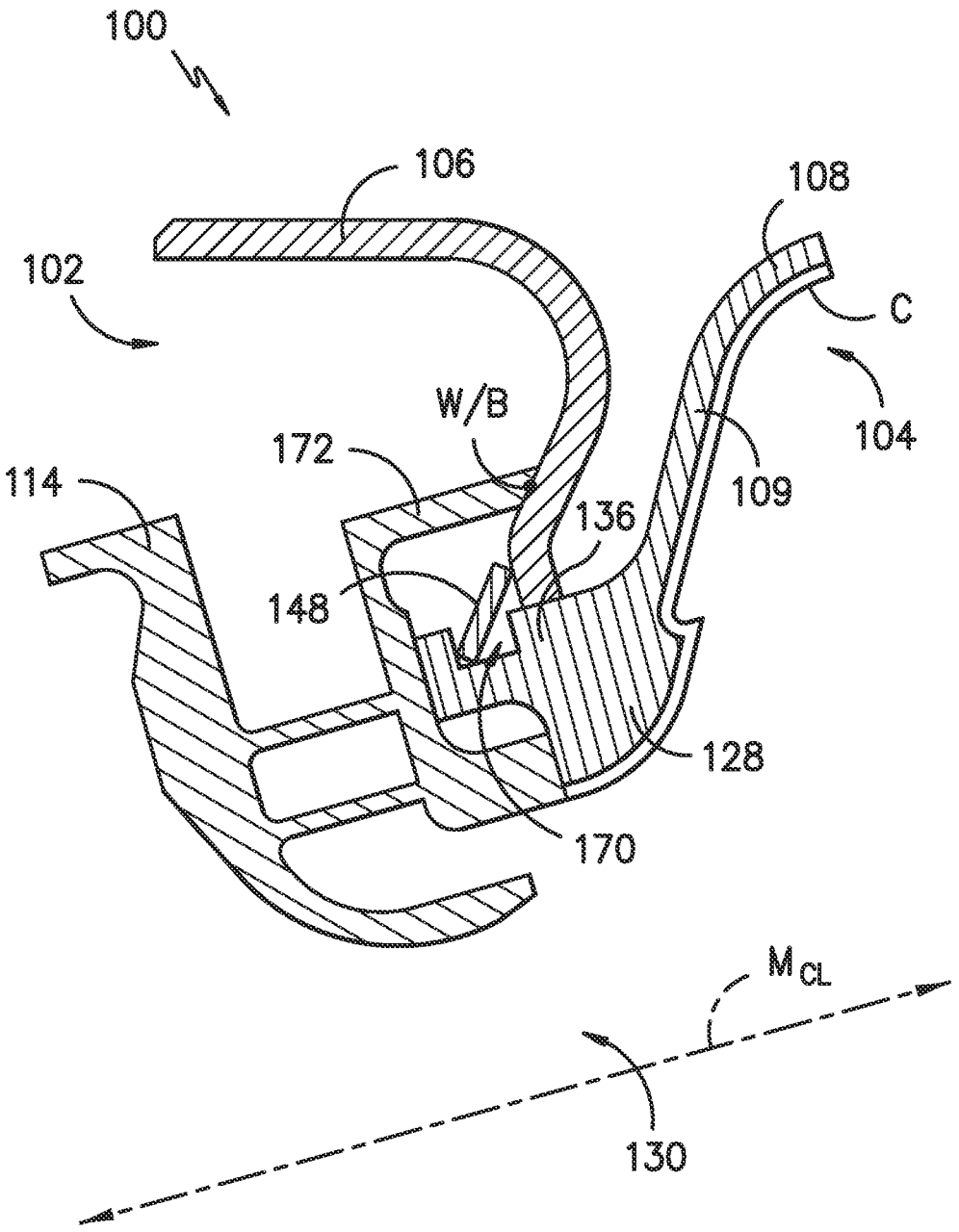

Turning to FIG. 10, in another embodiment of the combustor dome assembly 100, the seal plate 116 may be omitted such that the deflector 108 is positioned adjacent the combustor dome 106 in dome opening 110, and a portion of the mixer 114 may be configured to be positioned adjacent the combustor dome 106 on the forward side 102 of the combustor dome assembly 100. As shown in FIG. 10, the deflector 108 includes the flare cone 128 such that the flare cone 128 is made from a CMC material. Further, the deflector cup 136 defines a pocket 170 for receipt of a spring 148 that helps hold the deflector 108 in position as described in greater detail above, i.e., the spring 148 is positioned between the dome 106 and the deflector 108 to hold the deflector in place with respect to the combustor dome 106. The mixer 114 includes an outer arm 172 that extends toward the combustor dome 106 on the forward side 102 of the combustor dome assembly 100. The mixer 114 may be attached, e.g., brazed or welded, to the combustor dome 106 at the end of the outer arm 172. As such, the mixer 114 is used to hold the deflector 108 in place with respect to the combustor dome 106.

Figure 11:
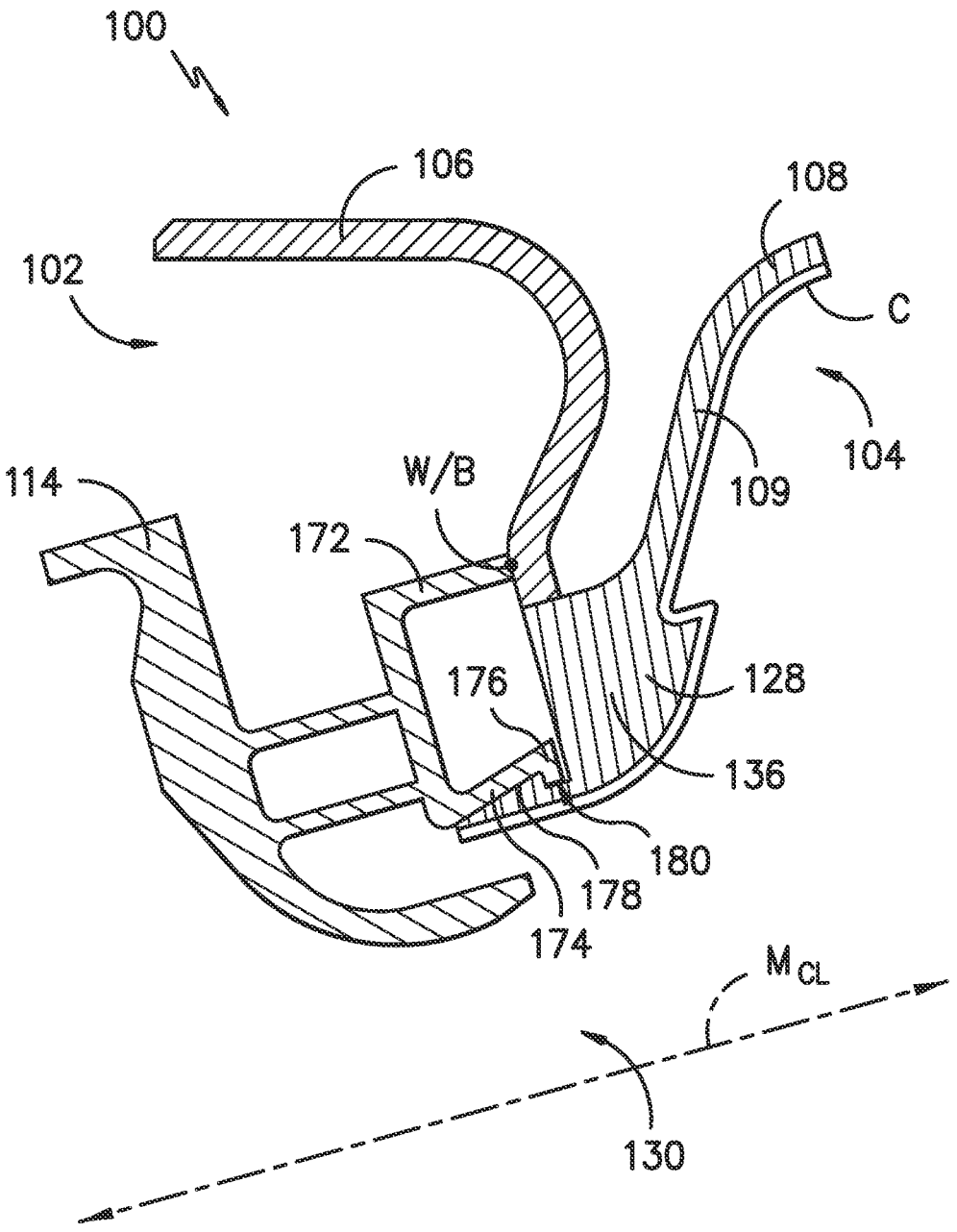

In the embodiment illustrated in FIG. 11, the seal plate 116 is omitted such that the deflector 108 is positioned adjacent the combustor dome 106 in dome opening 110, and similar to the embodiment of FIG. 10, the mixer 114 is used to hold the deflector 108 in place with respect to the combustor dome 106. Like the embodiment shown in FIG. 10, the mixer 114 illustrated in FIG. 11 includes an outer arm 172 that may be attached, e.g., brazed or welded, to the combustor dome 106. The mixer 114 also includes an inner arm 174 having a flange 176 at its aft end. The deflector 108 includes the flare cone 128, which transitions to a ramp portion 178 at the cup portion 136 of the deflector 108. The ramp portion 178 defines a groove 180 about its outer perimeter. As such, when the mixer 114 is assembled with the deflector 108, the mixer inner arm 174 slides up the deflector ramp portion 178 until the flange 176 is received in the groove 180 such that the flange 176 and groove 180 form a joint between the mixer 114 and the deflector 108. It will be appreciated that, although only one half of the cross-section of the mixer 114 and the deflector 108 are shown in the exemplary embodiment of FIG. 11, the inner arm 174, flange 176, and groove are generally annular. Accordingly, the interface or joint between the mixer 114 and deflector 108 at the flange 176 and groove 180 helps hold the deflector 108 in position with respect to the mixer 114 and combustor dome 106.

Figure 12:
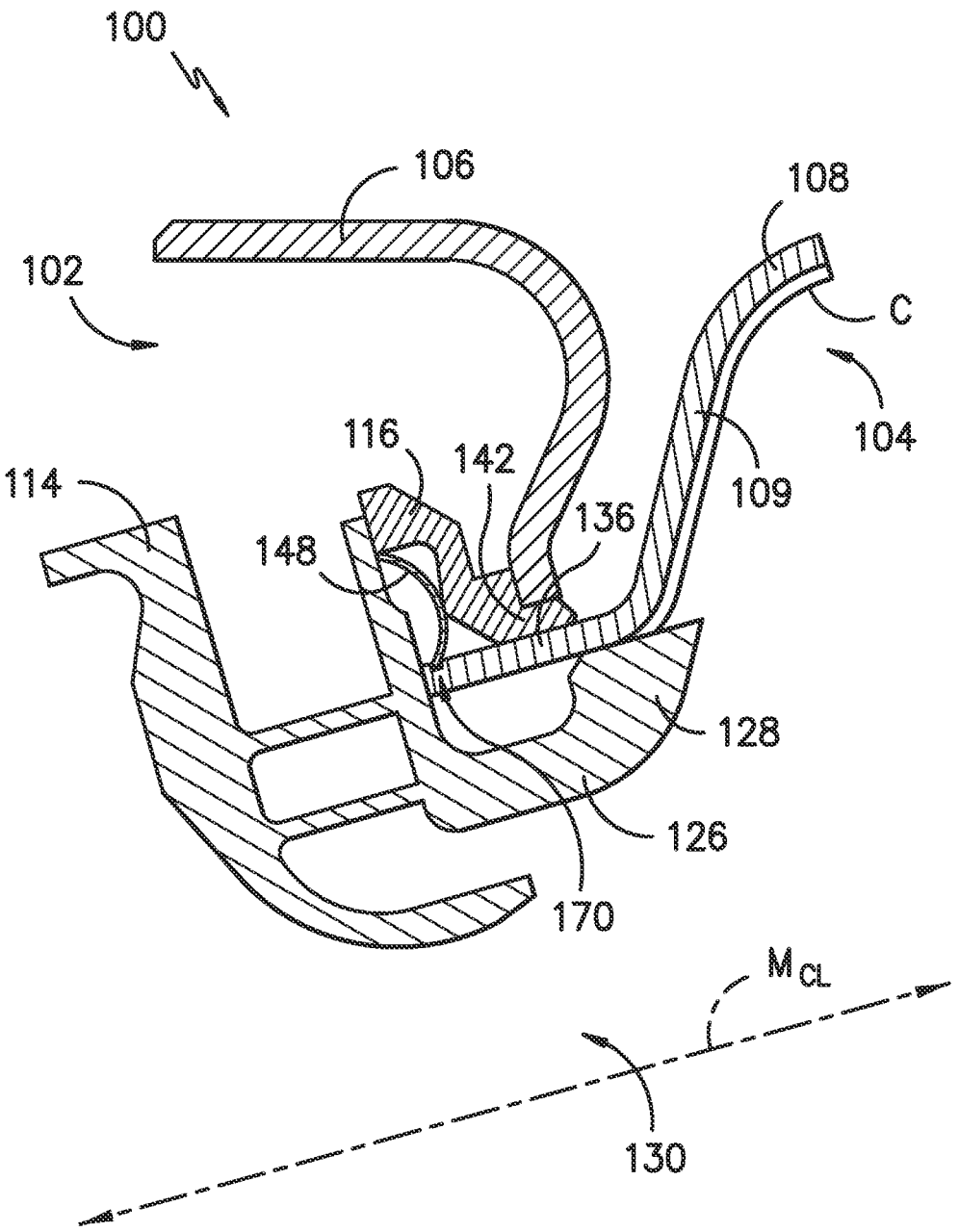

Referring now to FIG. 12, in another exemplary embodiment of the present subject matter, the cup 136 of the deflector 108 defines a pocket 170 for the receipt of a spring 148. The spring 148 extends generally from an interface between the mixer 114 and the seal plate 116 to the pocket 170 and helps holds the deflector 108 in position as described in greater detail above, i.e., the spring 148 is positioned between the mixer 114 and the deflector 108 to hold the deflector in place with respect to the combustor dome 106. Further, although FIG. 12 illustrates the flare cone 128 as included with the mixer 114, in suitable embodiments, at least a portion of the flare cone 128 may instead be included with the deflector 108.

Figure 13:
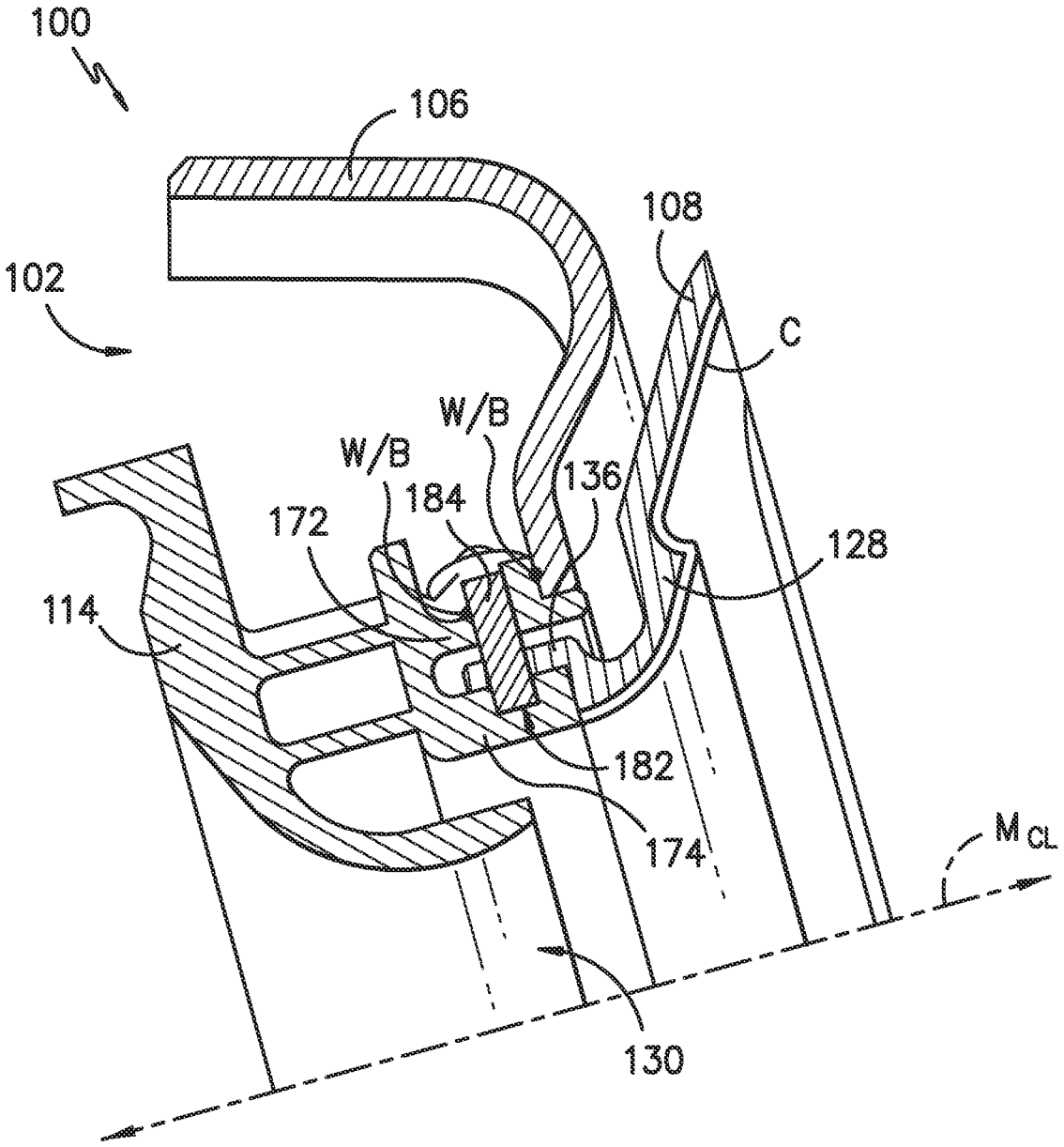

FIG. 13 provides a cross-section view of yet another embodiment of the present subject matter. In the embodiment shown in FIG. 13, the seal plate 116 is omitted, and the deflector 108 includes the flare cone 128. The mixer 114 includes an outer arm 172 and an inner arm 174, and a pocket 182 is defined in the inner arm 174. An aperture (not shown) is defined in each of the outer arm 172 and the deflector cup 136, and the apertures are configured for receipt of a pin 184. In some embodiments, a plurality of apertures may be defined in each of the outer arm 172 and the deflector cup 136 for receipt of a plurality of pins 184, in a configuration that generally may be described as a hub and spoke configuration. The pins 184 help hold the deflector 108 in position with respect to the mixer 114 and combustor dome 106. A retention mechanism may be used to help retain the pins 184 within the apertures, e.g., a weld may be used between each pin 184 and the mixer 114 to help retain each pin 184 in its respective mixer and deflector apertures.

As will be readily understood, the deflector 108 of the embodiments shown in FIGS. 7 through 13 preferably is formed from a CMC material such that the deflector is a CMC deflector 108, as described with respect to FIG. 6. As such, the CMC deflector 108 has a different rate of thermal expansion than the metallic components, e.g., the combustor dome 106, mixer 114, and seal plate 116. More particularly, the metallic components will grow faster than the CMC deflector 108 and will begin to thermally expand at lower temperatures than the CMC deflector 108. As such, the CMC deflector 108 and the metallic components may be appropriately sized such that the components may be assembled under cold, non-operating engine conditions with room to expand under hot, operating engine conditions. Further, as described above, the sizing of the various components may help retain the CMC deflector 108 in a desired position under cold and hot engine conditions.

Moreover, it will be appreciated that the above embodiments of the combustor dome assembly 100 may be retrofits of existing combustor dome assembly designs or may be implemented as new builds. For instance, existing fuel-air mixers may be modified to accommodate bayonets of new CMC deflectors 108 such that the deflector 108 as described herein may be utilized with existing combustor dome 106, mixer 114, and seal plate 116 components. However, some embodiments of, e.g., the mixer 114 described herein may not be suitable for modification of existing mixers and may require fabrication of new mixers 114.

Figure 14:
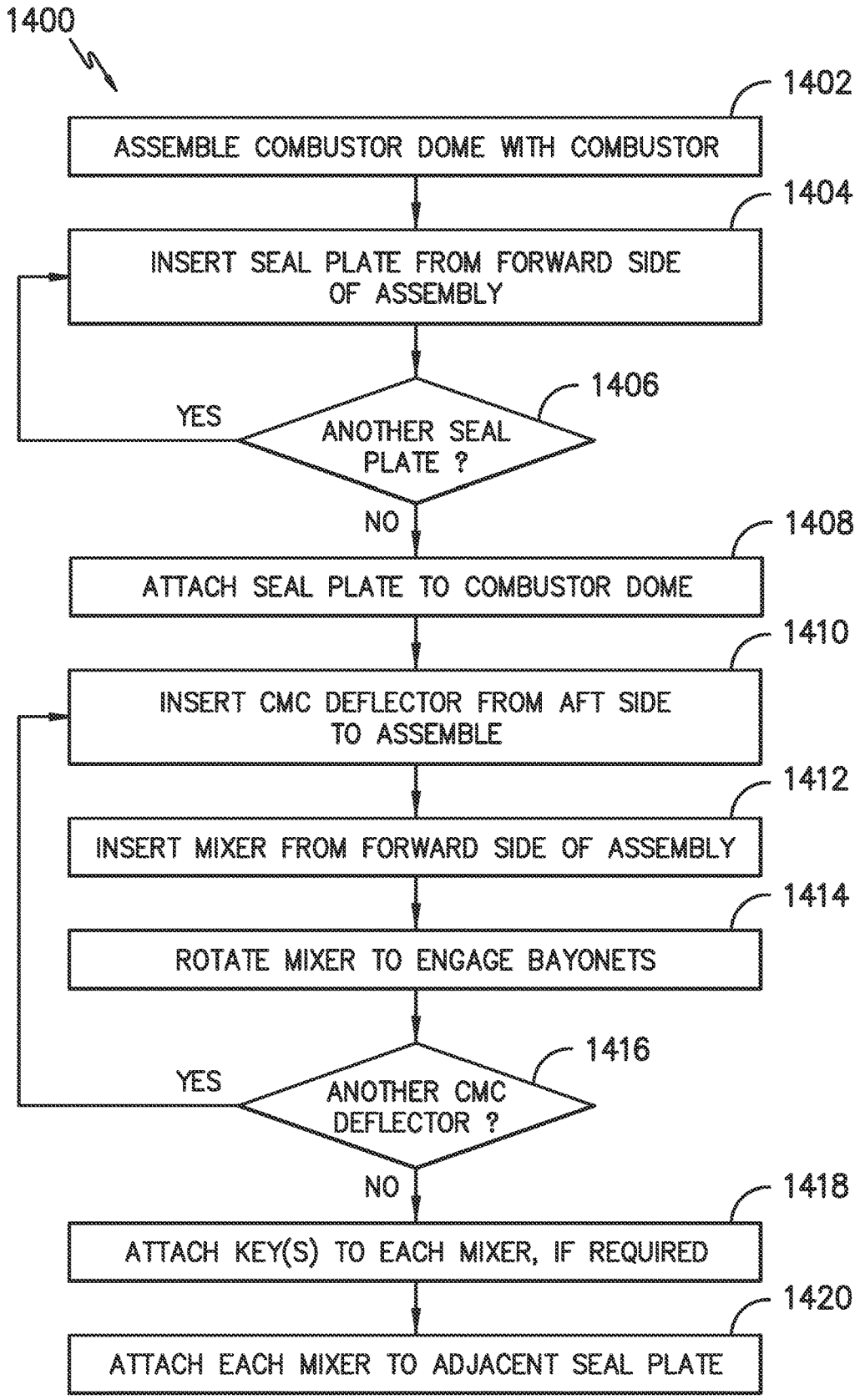
FIG. 14 provides a flow diagram illustrating a method of assembling a combustor dome assembly according to an exemplary embodiment of the present subject matter.

As illustrated by the flow diagram of FIG. 14, a method of assembling an exemplary combustor dome assembly 100 also may be provided. With particular reference to the embodiment shown in FIGS. 3 through 6, an exemplary method of assembly 1400 includes assembling the combustor dome 106 with the combustor, as shown at 1402 in FIG. 14. Then, as indicated at 1404, a seal plate 116 is inserted from the forward side 102, such that the seal plate wall 142 is inserted into the dome opening 110. Next, at 1408, it is determined whether there is more than one seal plate 116 in the combustor dome assembly 100, and if so, the process of inserting the seal plate 116 is repeated until each seal plate 116 is assembled with the combustor dome 106. For example, a seal plate 116 may be provided adjacent each dome opening 110, or a single seal plate 116 may include more than one seal plate wall 142 such that one seal plate 116 is positioned adjacent more than one dome opening 110. In any event, if more than one seal plate 116 is provided with the combustor dome assembly 100, the steps shown at 1404 and 1406 are repeated until all seal plates 116 are inserted. Then, the seal plates 116 are attached to the combustor dome 106, as shown at 1408, e.g., by welding or brazing. Thus, the seal plates 116 are attached to the combustor dome 106 before the CMC deflectors 108 are present.

Then, as shown at 1410 in FIG. 14, the CMC deflector 108 is inserted from the aft side 104 of the combustor dome assembly 100 such that the deflector cup 136 extends through the seal plate opening defined by the wall 142. Further, the seal plate key 140 is received in the deflector groove 138. Next, as shown at 1412, the mixer 114 is inserted from the forward side 102, with the mixer slots 124 aligned with the deflector bayonets 118 such that the aft end 122 of the mixer 114 slides past the bayonets 118 and the bayonets 118 are positioned in the groove 120. As indicated at 1414, the mixer 114 is then rotated to engage the bayonets 118 with the mixer 114 and thereby couple the deflector 108 and the mixer 114. As described with respect to seal plates 116 and as shown at 1416, in embodiments comprising a plurality of deflectors 108, steps 1410 through 1414 may then be repeated for each deflector 108 and mixer 114 such that a mixer 114 is inserted next to each one of the plurality of deflectors 108.

Next, as shown at 1418 in FIG. 14 and if required, a key may be attached within each mixer slot 124, e.g., by welding or brazing, to fill the slots 124 and to help prevent undesirable leakage and aerodynamic effects as described above. Finally, as indicated at 1420, each mixer 114 may be attached to its adjacent seal plate 116, for example, by welding or brazing the mixers 114 to the adjacent seal plate 116.

Method 1400 is provided by way of example only, and it will be appreciated that the method of assembly may be modified for other embodiments of the combustor dome assembly 100. For example, in embodiments in which the seal plate 116 is omitted, steps 1404 through 1408 are omitted.

As previously stated, the deflector 108 described in each of the exemplary embodiments herein is formed from a CMC material, and a method for forming a CMC deflector 108 first may comprise laying up a plurality of plies of the CMC material to form a CMC preform having a desired shape or contour. It will be appreciated that the plurality of CMC plies forming the preform may be laid up on a layup tool, mold, mandrel, or another appropriate device for supporting the plies and/or for defining the desired shape. The desired shape of CMC preform may be a desired shape or contour of the resultant CMC deflector 108. As an example, the plies may be laid up to define the deflector body 109 and the deflector cup 136. Laying up the plurality of plies to form the CMC deflector preform may include defining other features of the deflector 108 as well, such as the flare cone 128 and/or the pocket 170.

After the plurality of plies is laid up to form the preform, the preform may be processed, e.g., compacted and cured in an autoclave. After processing, the preform forms a green state CMC component, i.e., a green state CMC deflector 108. The green state CMC component is a single piece component, i.e., curing the plurality of plies of the preform joins the plies to produce a CMC component formed from a continuous piece of green state CMC material. The green state component then may undergo firing (or burn-off) and densification to produce a densified CMC deflector 108. For example, the green state component may be placed in a furnace to burn off any mandrel-forming materials and/or solvents used in forming the CMC plies and to decompose binders in the solvents, and then placed in a furnace with silicon to convert a ceramic matrix precursor of the plies into the ceramic material of the matrix of the CMC component. The silicon melts and infiltrates any porosity created with the matrix as a result of the decomposition of the binder during burn-off/firing; the melt infiltration of the CMC component with silicon densifies the CMC component. However, densification may be performed using any known densification technique including, but not limited to, Silcomp, melt-infiltration (MI), chemical vapor infiltration (CVI), polymer infiltration and pyrolysis (PIP), and oxide/oxide processes. In one embodiment, densification and firing may be conducted in a vacuum furnace or an inert atmosphere having an established atmosphere at temperatures above 1200° C. to allow silicon or another appropriate material or materials to melt-infiltrate into the component.

Optionally, after firing and densification the CMC deflector 108 may be finish machined, if and as needed, and/or coated with one or more coatings, such as an environmental barrier coating (EBC) or a thermal barrier coating (TBC). For instance, the pocket 170 utilized in some embodiments may be machined into the CMC deflector 108.

The foregoing method of forming a CMC deflector 108 is provided by way of example only. For example, other known methods or techniques for compacting and/or curing CMC plies, as well as for densifying the green state CMC component, may be utilized. Alternatively, any combinations of these or other known processes may be used.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A combustor dome assembly having a forward side and an aft side, the combustor dome assembly comprising:

a combustor dome defining an opening;

a ceramic matrix composite (CMC) deflector positioned adjacent the combustor dome on the aft side of the combustor dome assembly, the CMC deflector including a deflector body and a deflector cup extending forward from the deflector body through the opening in the combustor dome; and a fuel-air mixer positioned adjacent the combustor dome on the forward side of the combustor dome assembly, the fuel-air mixer including a radial base, a venturi extending from the radial base, and a first arm extending from the radial base and disposed radially outward of the venturi, wherein a forward end of the deflector body flares inward along a radial direction to form a flare cone, and wherein a pin extends through both an aperture defined in the first arm of the fuel-air mixer and an aperture defined in the CMC deflector, wherein the pin secures the CMC deflector to the first arm of the fuel-air mixer, and wherein the CMC deflector comprises a hole that extends entirely around an outer periphery of the pin such that the pin forms a retaining fit with the CMC deflector.

2. The combustor dome assembly of claim 1, wherein the first arm is positioned adjacent the deflector cup.

3. The combustor dome assembly of claim 2, wherein the first arm extends parallel to the deflector cup.

4. The combustor dome assembly of claim 2, wherein the fuel-air mixer includes a second arm, the deflector cup positioned between the first arm and the second arm.

5. The combustor dome assembly of claim 4, wherein the aperture defined in the CMC deflector is defined in the deflector cup, and a pocket is defined in the second arm, and wherein the pin extends through the aperture in the first arm, the aperture in the deflector cup, and into the pocket in the second arm.

6. The combustor dome assembly of claim 5, wherein the first arm is an outer arm along the radial direction and the second arm is an inner arm along the radial direction.

7. The combustor dome assembly of claim 1, wherein the pin is welded to the fuel-air mixer.

8. The combustor dome assembly of claim 1, wherein the pin is brazed to the fuel-air mixer.

9. The combustor dome assembly of claim 1, wherein the fuel-air mixer is welded to the combustor dome.

10. The combustor dome assembly of claim 1, wherein the fuel-air mixer is brazed to the combustor dome.

11. The combustor dome assembly of claim 1, wherein the pin is welded or brazed to the fuel-air mixer, and wherein the fuel-air mixer is welded or brazed to the combustor dome.

12. The combustor dome assembly of claim 1, wherein the flare cone extends between an aft end of the fuel-air mixer and an opening defined through the fuel-air mixer.

13. The combustor dome assembly of claim 12, wherein the flare cone contacts the aft end of the fuel-air mixer.

14. The combustor dome assembly of claim 1, wherein the deflector cup is integrally formed with the CMC deflector body.

15. A combustor dome assembly having a forward side and an aft side, the combustor dome assembly comprising:

a combustor dome defining an opening;

a deflector positioned adjacent the combustor dome on the aft side of the combustor dome assembly, the deflector including a deflector body and a deflector cup extending forward from the deflector body through the opening in the combustor dome; and a fuel-air mixer positioned adjacent the combustor dome on the forward side of the combustor dome assembly, the fuel-air mixer including a radial base, a venturi extending from the radial base, and an arm extending from the radial base and disposed radially outward of the venturi, and wherein a pin extends through both an aperture defined in the arm of the fuel-air mixer and an aperture defined in the deflector, wherein the pin secures the deflector to the arm of the fuel-air mixer, and wherein the deflector comprises a hole that extends entirely around an outer periphery of the pin such that the pin forms a retaining fit with the deflector.

16. The combustor dome assembly of claim 15, wherein a retention mechanism secures the pin to the fuel-air mixer.

17. The combustor dome assembly of claim 15, wherein the deflector is formed from a ceramic matrix composite (CMC) material such that the deflector cup is integrally formed with the deflector body from the CMC material.

* * * * *